United States Patent [19]

Waddington

[11] Patent Number: 4,742,780

[45] Date of Patent: May 10, 1988

[54] LOAD DISTRIBUTION SYSTEM FOR RAILWAY TRUCK

[75] Inventor: Ernest Waddington, Bath, Canada

[73] Assignee: Urban Transportation Development Corporation Limited, Toronto, Canada

[21] Appl. No.: 693,552

[22] Filed: Jan. 22, 1985

[51] Int. Cl.[4] ..... B61F 5/38

[52] U.S. Cl. ..... 105/168; 105/200

[58] Field of Search ..... 105/165, 167, 168, 179, 105/199 R, 199 C, 200, 185

[56] References Cited

U.S. PATENT DOCUMENTS

| | | | |
|---|---|---|---|
| 700633 | 5/1902 | Ehrhardt | 89/40.01 |
| 2,288,383 | 6/1942 | Anderson | 105/185 |
| 3,150,611 | 9/1964 | Kugler et al. | 105/199 R |
| 3,313,245 | 4/1967 | Sundby | 105/197 R |
| 3,548,755 | 12/1970 | Lich | 105/199 R |
| 3,628,465 | 12/1971 | Dobson et al. | 105/199 R X |
| 3,802,350 | 4/1974 | Hicks et al. | 105/199 A X |
| 3,845,724 | 11/1974 | Boocock et al. | 105/199 R X |
| 3,884,155 | 5/1975 | Maroshick | 105/210 X |
| 3,884,157 | 5/1975 | Pelabon | 105/199 R |
| 4,131,069 | 12/1978 | List | 105/168 |
| 4,134,343 | 1/1979 | Jackson | 105/167 |
| 4,221,172 | 9/1980 | Sobolewski | 105/168 |
| 4,455,033 | 6/1984 | Becker et al. | 105/3 X |
| 4,457,238 | 7/1984 | Sobolewski | 105/168 |
| 28434177 | 7/1958 | Wahl etal. | 105/3 X |

FOREIGN PATENT DOCUMENTS 202183 2/1959 Austria .

*Primary Examiner*—Robert B. Reeves
*Assistant Examiner*—Frank Williams
*Attorney, Agent, or Firm*—Spencer & Frank

[57] ABSTRACT

A bolster for a railway truck is supported at opposite ends on side frames. The side frames are themselves supported at spaced longitudinal points on wheelsets that are steerable to attain a radial position relative to the curve of a track. The side frames are moveable relative to one another to accommodate the steering motion of the wheelsets and a linkage is provided between the bolster and each of the side frames to locate the bolster and distribute the lateral loads between the two side frames. The linkage comprises a pair of struts each mounted at one end to a respective side frame and connected at the other end to a common link. The link is pivotally connected to the underside of the bolster intermediate the two struts.

10 Claims, 8 Drawing Sheets

LOAD DISTRIBUTION SYSTEM FOR RAILWAY TRUCK

The present invention relates to trucks and in particular to trucks intended for use on railways.

Railway trucks are, of course, well-known and in recent years attempts have been made to improve the performance of these trucks. Attention has been directed to improving the tracking characteristics of such trucks and to improving their stability. In operation a railroad truck must satisfy a number of conflicting criteria with respect to robustness, flexibility and load carrying capacity. Such trucks must, of course, be capable of remaining in service for long periods and, therefore, undue complexity in the design of the truck is to be avoided. This has tended to produce a truck in which a basically rigid frame is utilised to maintain the wheelsets of the truck parallel. However, a simple rigid frame truck has proved unsatisfactory in terms of uniform axle loading as a rigid frame does not produce the required torsional flexibility to allow movement of one or more of the wheels out of a plane containing the remaining wheels. Such movement is desirable to accommodate minor deviations in the track and also to accommodate curves which are banked to avoid high lateral loads beteen the wheels and rails. To overcome this problem trucks have been designed with increased flexibility between opposed side frames, but these trucks still operate to maintain the wheels in a generally parallel configuration.

With the wheels held in a parallel configuration, it is not unusual for the flanges of the wheels to hit the flanks of the rails upon which they are running, particularly as the trucks enter a curve. To overcome this and to improve the rolling characteristics of the truck, attempts have been made to produce a truck in which the wheelsets are turned to a position in which they are radial to a curve around which the truck is running. Such trucks have not found general favour because of the increased complexity of the design which has been considered a detriment to the robustness of the trucks.

One truck that has found acceptance whilst addressing the problem noted above is described in U.S. Pat. No. 4,457,238 to Sobolewski. In this truck, the required torsional flexibility is provided by utilising a pair of side frames that may move independently of one another. The side frames are supported on laterally spaced wheelsets and a bolster extends transversly between the side frames to support the vehicle body. The wheelsets are arranged to be rotatable about respective vertical axes so that they can adopt steering positions as dictated by the connection between the bolster and one of the wheelsets. The truck in the above application is flexible and yet has the desired simplicity of construction for robustness. The side frames are connected to one of the wheelsets by pinned connections and to the other of the wheelsets by lateral links that maintain the side frames in spaced relationship. The bolster is connected to the side frames by a laterally extending link extending from one of the side frames to the center point of the bolster. This arrangement satisfactoriy locates the bolster relative to the side frames and also permits the required deformation of the side frames as the axles adopt a radial position.

It will be appreciated that as the side frames move to a radial position there is both relative longitudinal movement and a relative lateral movement between them caused by the change in geometry of the wheelsets. Because of the flexible nature of the side frames a single link extending between one of the side frames and the bolster has been utilised to allow the required deformation. Whilst this has proved satisfactory in practice, it is felt that the imposition of all the lateral loads from the bolster to the truck through one of the side frames may impose undue loads on the side frame and thereby increase the dimensions of that side frame.

It is therefore an object of the present invention to obviate or mitigate the above disadvantages.

According therefore to one aspect of the present invention there is provided a truck comprising a pair of wheelsets spaced apart along a longitudinal axis and extending generally transverse thereto, a pair of side frames disposed on opposite sides of said longitudinal axis and each extending between said wheelsets to be supported thereby, a bolster extending transversely between said side frames and supported thereby for rotation about a vertical axis and link means to locate laterally said bolster and transfer lateral loads between said bolster and said side frames, said link means including an arm having opposite end portions spaced apart in the direction of said longitudinal axis, pivot means located intermediate said ends to connect said arm to said bolster for relative rotation therebetween, and a pair of struts each pivotally connected to said arm on opposite sides of said pivot means to accommodate pivotal movement between said arm and said struts about respective vertical axes, each strut being connected to a respective one of said side frames whereby a lateral load on said bolster is transferred through said arm to each of said struts and its associated side frame.

According to a further aspect of the present invention there is provided a steerable truck comprising a pair of wheelsets spaced apart along a longitudinal axis and extending transverse thereto, a pair of side frames disposed on opposite sides of said longitudinal axis and extending between said wheelsets to be supported thereby, connecting means to connect each of said side frames to one of said wheelsets and accommodate relative pivotal movement between said side frames and said one wheelset about a vertical axis, locating means acting between said side frames and the other of said wheelsets to inhibit lateral movement of said side frames relative to said one wheelset, a bolster extending laterally between side frames and pivotally supported thereby for rotation about a vertical steering axis, and link means to locate laterally said bolster relative to said side frame, said link means including an arm pivotally connected to said bolster for rotation about an axis coincident with said steering axis, a pair of struts pivotally connected to said arm at locations spaced apart along the longitudinal axis and on opposite sides of said steering axis for rotation about a vertical axis, each of said struts being connected to a respective one of said side frames whereby relative longitudinal or lateral movement between said side frames is accommodated by rotation of said arm about said steering axis and lateral loads are transmitted from said bolster through said arm and struts to said side frames.

Embodiments of the present invention will now be described by way of example only with reference to the accompanying drawings in which, FIG. 1 is a side view of a railway vehicle.

Figure 1:
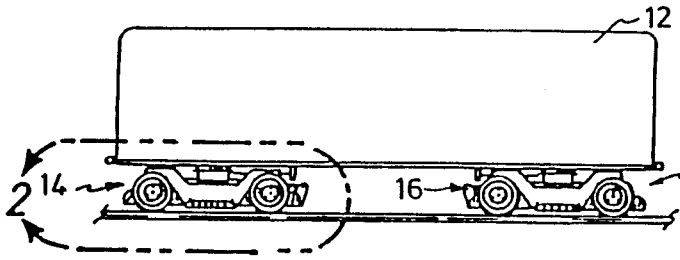

Referring to the drawings, a rail vehicle 10 includes a body 12 supported on a pair of trucks 14, 16. Each of the trucks 14, 16 is similar and therefore only one will be described in detail.

The truck 14 may best be seen in FIGS. 2 through 7 and includes a pair of wheelsets 18, 20 spaced apart along the longitudinal axis of the truck. The wheelsets 18, 20 are similar and therefore only wheelset 18 will be described in detail with like reference numerals indicating similar components of wheelset 20 with a suffix "a" added for clarity. Wheelset 18 includes a pair of flanged wheels 22 interconnected by an axle 24. The axle 24 is rotatably supported at laterally spaced locations in bearing assemblies 26, that are of conventional construction and will not be described further. The bearing assemblies 26 are connected to flanges 28 of laterally extending arms 30, 32 respectively of a steering yoke 34. A tongue 38 extends along the center line of the truck 14 toward the wheelset 20 and is received within a clevis 42 formed on tongue **38*a* of wheelset 20. The tongues 38, 38*a* are interconnected by a pin 44 that permits relative pivotal movement between the tongues 38, 38*a* about a vertical axis. The pin 44 is located on the tongue 38 by elastomeric bushing 46 to accommodate limited lateral and longitudinal displacement between the ends of the tongs 38, 38*a*** as well as relative torsional movement between the ends of the tongs.

A pair of side frames 48, 50 are located on opposite sides of the longitudinal axis and extend between the wheelsets 18 and 20. Each of the side frames 48, 50 is connected to the bearing assemblies 26 of the wheelset 18 by means of pins 52, 54 respectively. Elastomeric blocks 56, 58 are positioned between the underside of the side frames 48, 50 and upper surfaces of the bearing assemblies 26 to provide a primary suspension for the vehicle 10. The pins 52, 54 provide a pivotal connection to accommodate relative movement between the side frames and the wheelset 18 about a vertical axis.

The lateral location of the side frame 48 relative to the wheelset 18 is controlled by means of a lateral link 60 that extends between brackets 62, 64 provided on the side frame 48 and wheelset respectively 18. The lugs 64 are located on the center line of the truck 14 and projects upwardly so that the link 60 lies in a horizontal plane. Pins 66, 68 extend along horizontal longitudinal axes and connect the link 60 to the lugs 62, 64. Elastomeric bushings (not shown) are interposed between the pins and link 60 to provide limited universal movement.

Figure 5:
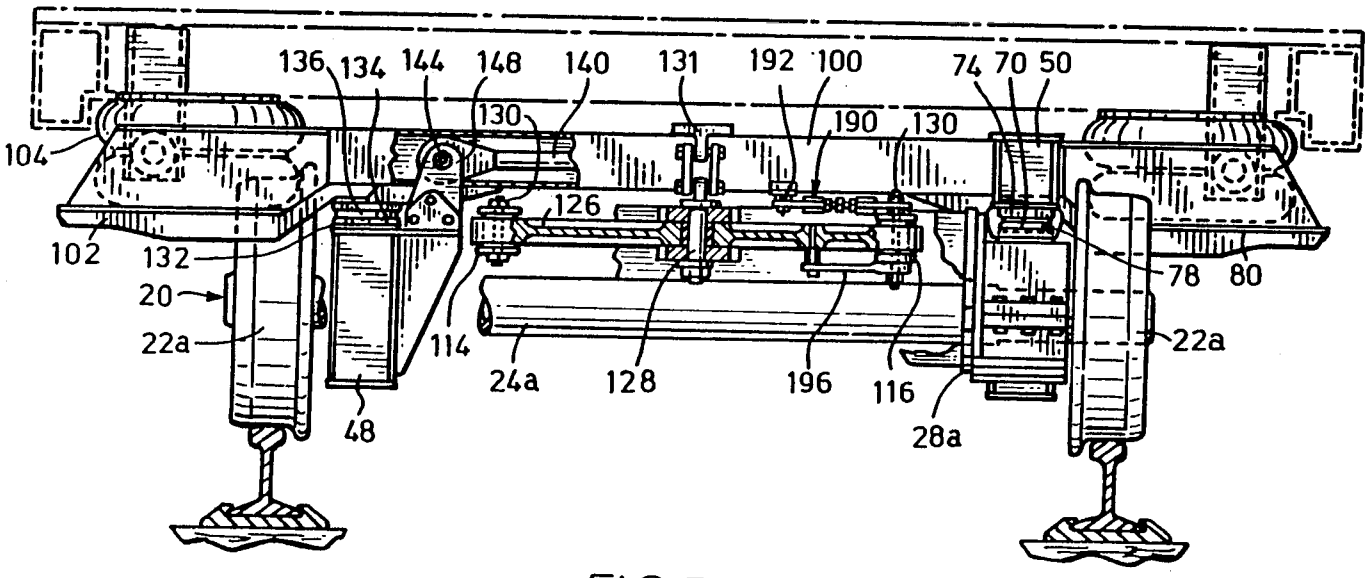
FIG. 5 is a view on the line 5—5 of FIG. 3.

As can best be seen in FIG. 5 the side frames 48, 50 are supported on the wheelset 20 by means of slide blocks 70 attached to the upper surface of each of the bearing assemblies **26*a*. Elastomeric blocks 74 are interposed between the side frames 48, 50 and the slide blocks 70 and are secured to the underside of the side frames. The lower surface of the elastomeric block is provided with a plate 78 that slides upon an upwardly directed surface 80 on the slide block 70**.

The lateral location of the side frames 48, 50 relative to the wheelset 20 is controlled by a pair of lateral links 80, 82. The links 80, 82 are connected to horizontal plates 84 extending from the yoke **36*a*. Pins 88, 90 depend from the plate 84 and are received within elastomeric bushings (not shown) to provide limited universal movement between the links and the steering yoke. The opposite end of the links 80, 82 are located between spaced vertical plates 92, 94 on the side frames 48, 50 and connected to the plates by pins 96 that pass through elastomeric bushings (not shown). The pins 88, 90 are disposed along a vertical axis whereas the pins 96 are disposed on a generally horizontal axis although the elastomeric bushings accommodates limited movement about other axes. The effect of the lateral links 80, 82 is to establish a virtual center of rotation of the steering yoke 36*a* about the intersection of the center line of the truck 12 and the axle 24*a***.

Figure 2:
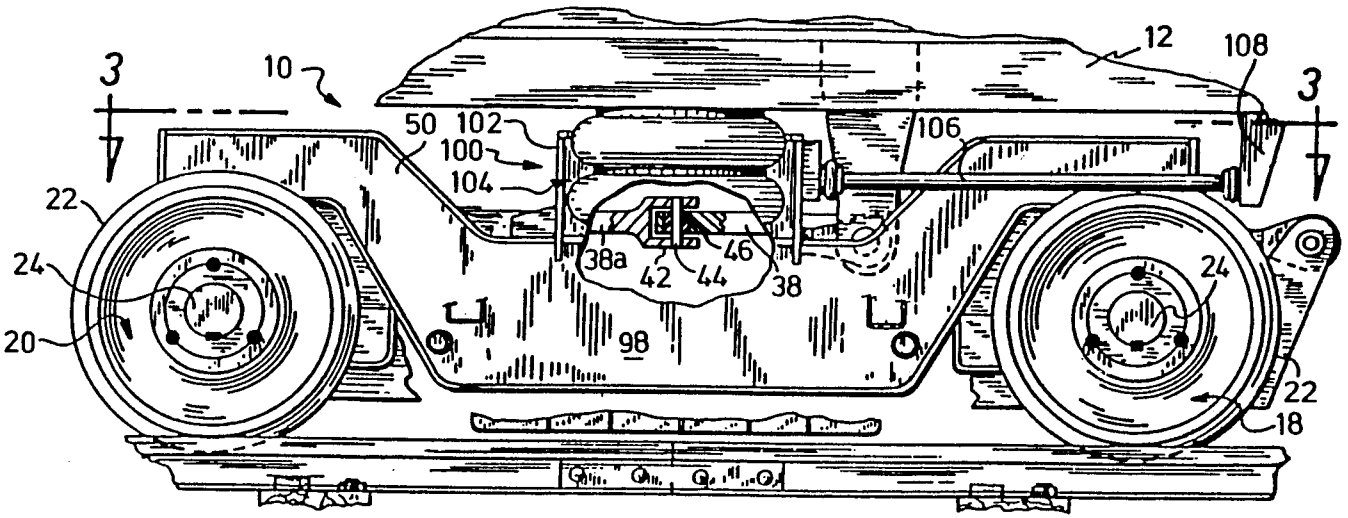
FIG. 2 is an enlarged side view of a truck used on the vehicle of FIG. 1.
Figure 3:
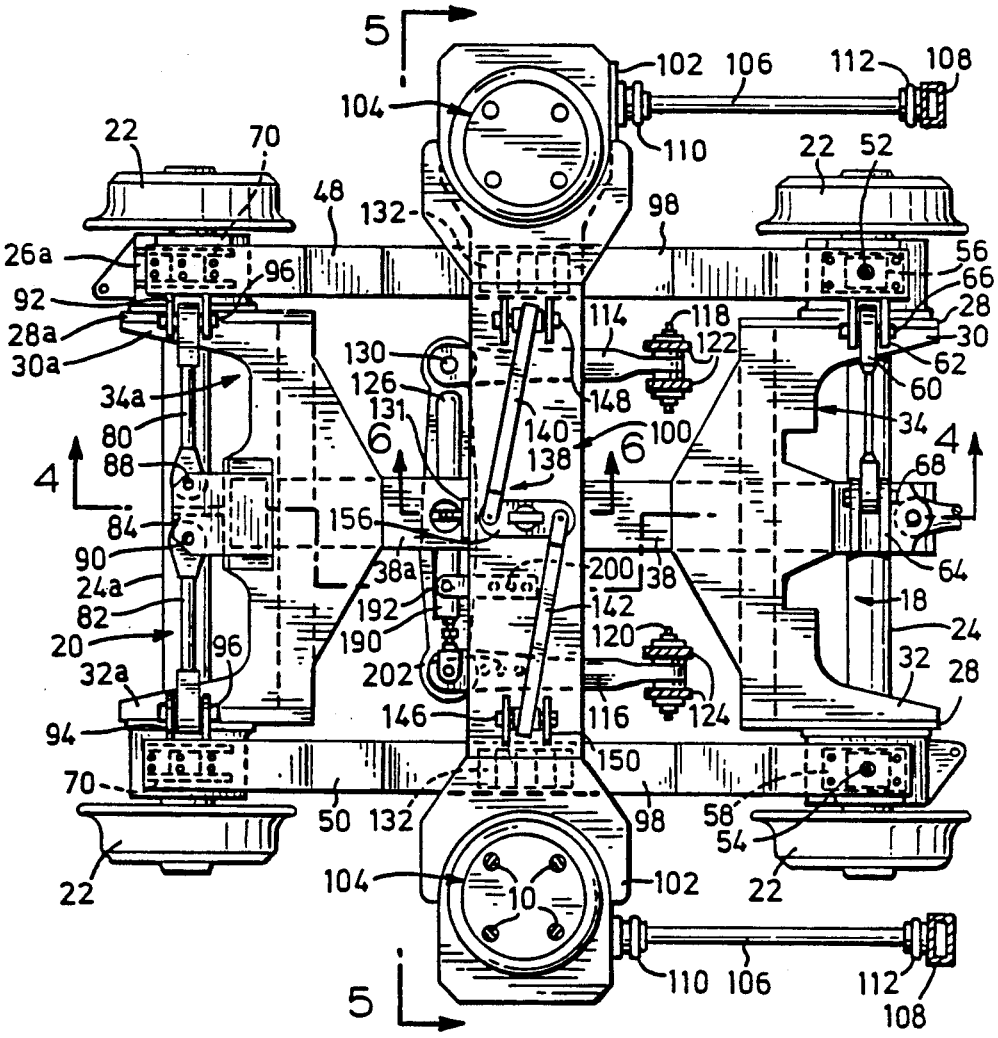
FIG. 3 is a plan view of the truck shown in FIG. 2 with portions of the truck removed for clarity.
Figure 4:
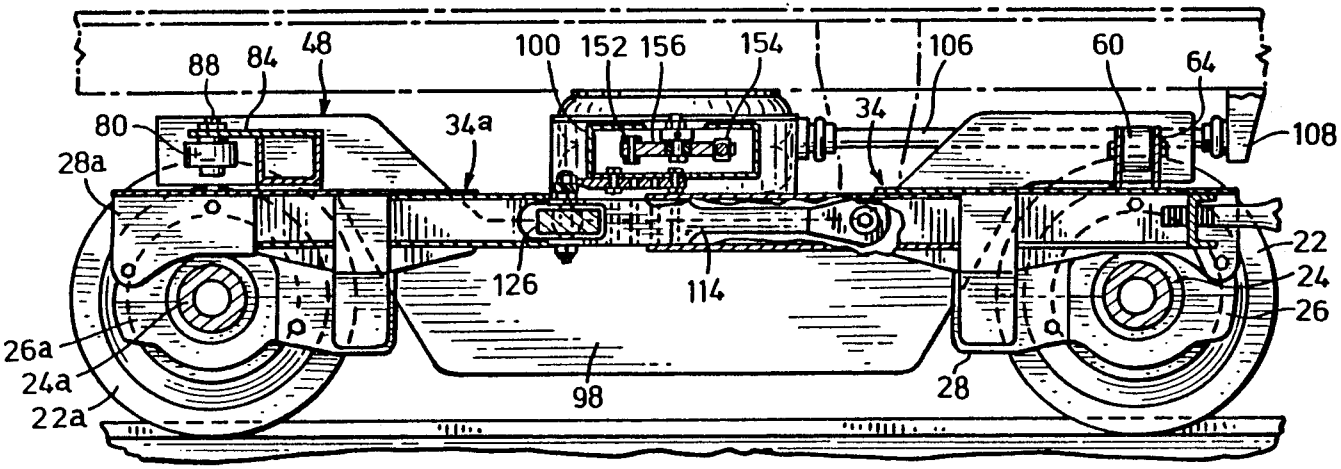
FIG. 4 is a section on the line 4—4 of FIG. 3.

As can best be seen in FIGS. 2, 3 and 4 the side frames 40, 50 each include a depressed portion 98 between which extends a bolster 100. The bolster 100 is of rectangular hollow section and is formed with end plates 102 at opposite ends to receive the air springs 104 that are interposed between the body 12 and the truck 14. Longitudinal struts 106 extend between the plates 102 and downwardly projecting pedestals 108 formed on the body to inhibit relative longitudinal movement between the body and the bolster 100. Elastomeric bushings 110, 112 are disposed at opposite ends of the struts 106 to accommodate relative movement between the body and the bolster as permitted by the air springs 104.

Longitudinal draft forces are transmitted between the body 12 and the truck 14 by means of longitudinal struts 114, 116 that are connected by pins 118, 120 respectively to downwardly projecting pedestals 122, 124 formed on the underside of the body 12.

The struts 114, 116 are connected to opposite ends of a tie bar 126 that is also pivotally connected by a pin 128 (FIG. 5) to the tongue **38*a* of steering yoke 36*a*. The struts 114, 116 are connected to the opposite ends of the tie bar 126 by pins 130 disposed along a vertical axis. In this way relative lateral movement between the car body 12 and the bolster 100 will simply cause deformation of the parrallelogram defined by the struts 114, 116 and tie bar 126 and will not induce any displacement of the tongue 38*a*. For similar reasons the pins 118, 120 that connect the struts 114, 116 to the pedestals 122, 124 are disposed on a horizontal axis so that vertical movement between body and bolster will be accommodated by pivotal movement between the pedestals and the struts. Each of the pins 118, 120, 130 is received within an elastomeric bushing to provide limited pivotal movement between the components about mutually perpendicular axes. A hanger assembly 131 (FIG. 5) is provided on the bolster 100 and is pivotally secured to an extension of the pin 128 to support the tie bar 126 and tongue 38*a*** at their point of intersection in a horizontal plane.

As the bolster 100 is connected to the body 12 by means of the struts 106 it is necessary to provide for rotational movement between the bolster 100 and the side frames 48, 50 about a vertical axis to accommodate relative movement between the truck 14 and body 12 as the vehicle enters a curve.

Bearing pads 132 are provided on the upper surface of the side frames 48, 50 respectively and cooperate with plates 134 provided on the undersurface of elastomeric blocks 136 that are connected to the underside of the bolster 100. The pads 132 and plates 134 are coated with a low coefficient friction material such as Teflon (Registered Trade Mark) so that relative sliding movement between the bolster and the side frames 48, 50 may be accomplished with the minimum of friction. The bolster 100 is constrained for movement about a generally vertical axis located on the center line of the truck 12 by means of a linkage generally designated 138 located generally within the bolster 100. The linkage 138 comprises a pair of lateral struts 140, 142 that are connected to the side frames 48, 50 respectively by pins 144. The pins 144, 146 each extend along a horizontal axis between a pair of spaced vertical plates 148, 150 secured to the side frames 48, 50 and are provided with elastomeric bushings between the pins and struts to accommodate limited universal movement between the struts 140, 142 and respective side frames 48, 50.

Figure 6:
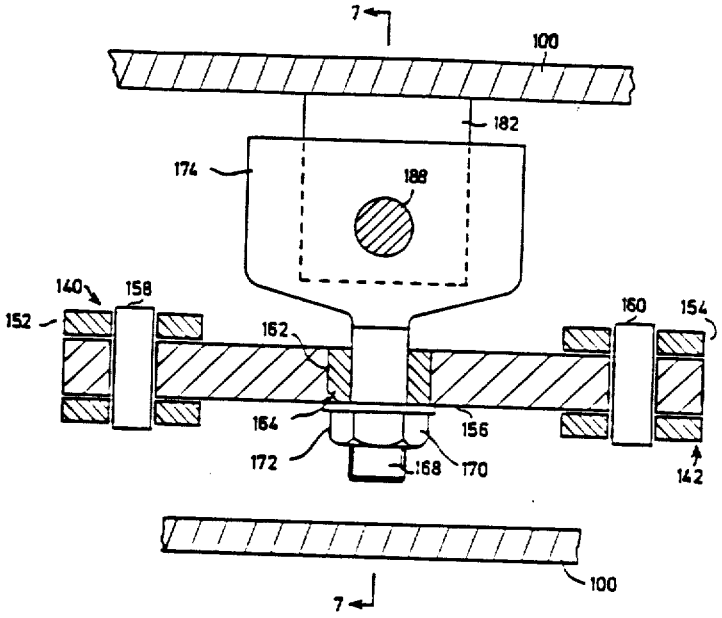
FIG. 6 is an enlarged view of a portion of the truck shown in FIG. 3 taken on the line 6—6.
Figure 7:
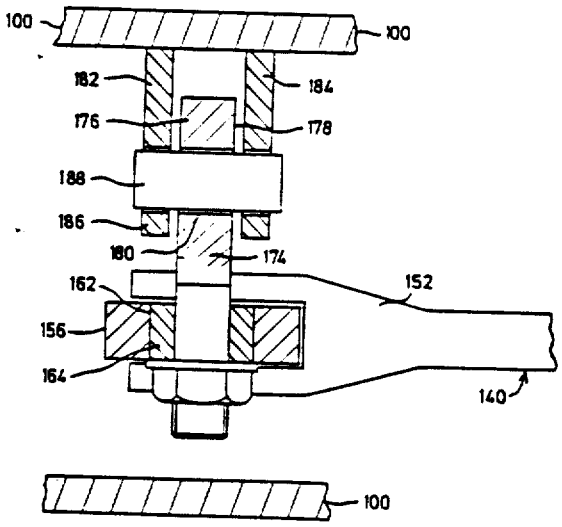
FIG. 7 is an enlarged view of a portion of the truck taken on the line 7—7 of FIG. 6.

As best can be seen in FIGS. 6 and 7, the opposite ends of struts 141, 142 are each formed with clevises 152, 154 to pass over opposite ends of a link 156. The clevises 152, 154 are connected to the link 156 by pins 158, 160 respectively that extend along a generally vertical axis. The link 156 is formed with a bore 162 intermediate the pins 158, 160 with an elastomeric bush 164 located within the bore. The bush 164 is annular and receives within a cental bore 166 a shaft 168. The shaft has a threaded end portion 170 to which is secured a nut 172 to retain the link 156 on the shaft 168. The upper end of shaft 168 is enlarged to provide a generally rectangular head 174 with spaced parallel faces 176, 178. A bore 180 extends between the faces 176, 178 generally transverse to the axis of the shaft 168. The head 174 is received between a pair of spaced vertical plates 182, 184 that constitute a bracket suspended from the underside of the top plate of bolster 100. Each of the plates 182, 184 has a bore 186 to receive a pin 188 that extends between the plates and through the bore 180 on the head 174. The pin 188 pivotally connects the shaft 168 to the bolster so that the bolster 100 is constrained for movement about a generally vertical axis defined by the longitudinal axis of the shaft 168.

Referring to FIG. 3, the bolster 100 is also connected to the tie bar 126 by means of a steering link 190 that extends from a bracket 192 connected to the forward edge of the bolster 100 and an upwardly projecting extension 194 of pin 130. A balancing link 196 is provided on the underside of the tie bar 16 to extend between a downwardly extending projection 198 of the pin 130 and the tie bar 126. In this way any lateral forces in the steering link 190 are balanced by corresponding forces in the balancing link 196 to avoid displacement of the pin 130 from a vertical axis.

It will be noted from FIG. 3 that the links 190 and 196 may be connected in one of a series of holes 200, 202 in the bracket 192 and strut 114 respectively. The holes 200, 202 are spaced apart along the longitudinal axis of the truck and provide a selective feedback for the truck steering mechanism.

The operation of the truck will now be described assuming that it is initially in a straightline condition, that is with the wheelsets parallel. In this condition, the weight of the body 14 is supported on the bolster 100 and transmitted into the side frames 48, 50 to respective wheelsets 18, 20. Vertical movement of the body 14 relative to the bolster 100 is accommodated in the air spring 104 and by relative pivotal movement between the struts 114, 116 and the pedestals 108.

Draft forces between the body and the truck such as may be induced by acceleration or deceleration of the vehicle are transmitted through the struts 114, 116 to the tie bar 126 and into the steering yoke 36. The forces are thus transmitted through the tongues **38, 38*a* into the wheelsets 18, 20** rather than being transmitted to the side frames.

Undulations in the track upon which the vehicle is running is accommodated by movement of one of the wheels 22 out of the plane containing the other wheels. This is permitted due to the relatively flexible connection between the side frames 48, 50 and their respective wheelsets with the side frames 48, 50 being maintained in generally parallel relationship by the link 60 and the lateral links 80, 82.

Upon the vehicle entering a curve the conicity of the wheels 22 will cause rotation of the truck 14 relative to the body 12 about a vertical axis. The bolster 100 moves with the vehicle body rather than with a truck by virtue of the longitudinal strut 106 and therefore slides upon the pads 132. The axis of rotation of the bolster 100 is defined by the axis of the shaft 168 which is laterally located by means of the lateral links 140, 142. Any lateral forces imposed upon the bolster 100 are transmitted to the shaft 168 to attempt to bodily displace the link 156 laterally. Such displacement is opposed by forces in the struts 140, 142 attempting to rotate the link 156 relative to the shaft 168 in opposite directions. Thus, a compressive load is established in one of the struts and a corresponding tensile load in the other of the struts which is reacted at the side frames 48, 50. The lateral links 80, 82 and the link 60 opposes relative movement between the side frames so that the bolster is effectively located on the vertical axis defined by the shaft 168.

Figure 8:
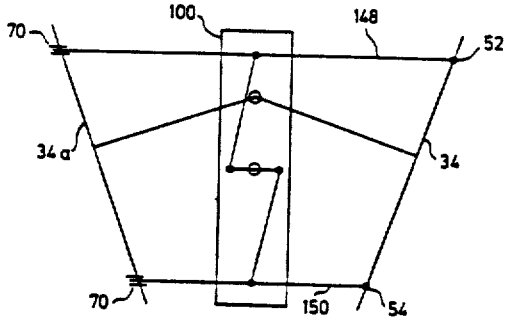
FIG. 8 is a schematic illustration of the components of the truck shown in FIGS. 1 through 7 with the component shown in two different positions.

As the truck enters a curve the rotation of the bolster 100 relative to the side frames 48, 50 causes displacement of the hanger assembly 131 to displace the pin 128 laterally. The displacement of the pin 128 causes a rotation of the yoke 36 about its steering axis and a corresponding rotation of the yoke 34 in an opposite sense about its steering axis. The wheelsets 18, 20 thus move out of a parallel relationship into a configuration as shown in FIG. 8. The movement of the wheelsets to the radial position shown in FIG. 8 causes relative longitudinal displacement between the side frames 48, 50. The pinned connection between the side frames 48, 50 and the steering yoke 34 causes the longitudinal distance between the bearing assemblies **26, 26*a* on one side of the vechicle to decrease and the distance between the bearing assemblies 26 on the opposite side of the side frame to increase. This variation in distance is accommodated by sliding movement of the side frames 48, 50 on the slide blocks 72, 70. The movement of the wheelsets 18, 20 also causes the lateral spacing between the side frames to decrease causing the attachment points between the struts 140, 142 and their respective side frames to move both longitudinally and laterally. Such movement is accommodated by rotation of the link 156 about the shaft 168 as accommodated by the elastomeric bushing 164 so that the bolster 100 remains centered on the truck. The struts 140, 142 upon the relative longitudinal and lateral movement between the side frames induce equal and opposite turning moments of the link 156 about the shaft to maintain the bolster 100** centered.

It will be seen therefore that the linkage 138 is effective to maintain the bolster 100 centered while resisting lateral forces that would tend to displace the bolster relative to the side frames. The linkage 138 ensures that the lateral loads are uniformly distributed between the side frames 138, but at the same time permits the relative movement between the side frames 48, 50 necessary for the truck to move to a steering position. In this way the flexibility of the truck can be maintained whilst the load distribution through the truck is accommodated in a uniform manner.

Figure 9:
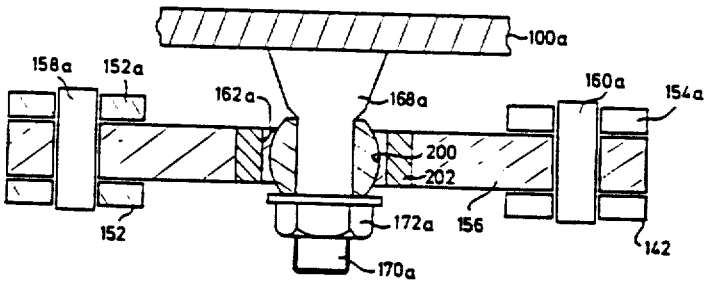
FIG. 9 is a view similar to FIG. 6 showing an alternative embodiment to the structure shown in FIG. 6.
Figure 10:
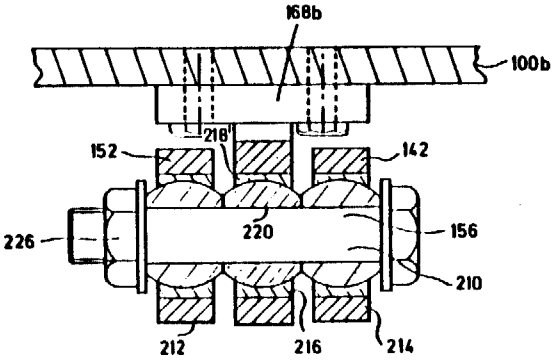
FIG. 10 is a view similar to FIG. 6 showing a further alternative embodiment of the structure shown in FIG. 6.

An alternative to the support structure for the link 156 is shown in FIGS. 9 and 10 and like components will be identified by the same reference numeral as used in FIG. 6 with a suffix a and b added with respect to FIGS. 8 and 9 respectively for clarity of description.

Referring therefore to FIG. 9 the shaft **168*a* is rigidly secured to the bolster 100*a* and is formed with a spherical bearing surface 200 immediately adjacent the threaded portion 170*a*. The elastomeric bush 164 used in the embodiment of FIG. 6 is replaced by a socket 202 that is received within the central bore 162*a* and has an inner surface that conforms to the curvature of the spherical portion 200. The socket is preferably formed from a self lubricating material such as nylon or alternatively may be formed from steel with the curved inner surface coated with a low coefficient friction material such as PTFE. The surface 200 and socket 202 thus provides for limited universally movement of the link 156*a* relative to the bolster 100*a* in a manner provided by the pin 188 and elastomeric bushing 164 of the embodiment of FIG. 6**.

In the embodiment of FIG. 10 the link 156 is replaced with a bolt 210. The clevises 152 and 154 are replaced with ball and socket joints indicated at 212, 214 respectively. Each of the ball and socket joints 212, 214 permits limited universal movement between their respective lateral struts **140*b*, 142*b***.

The shaft **168*b* is formed with a transverse horizontal aperture 216 within which is located a ball and socket joint 218. The bolt 210 passes through a central bore 220 in the ball and socket joint so as to be universally mounted relative to the shaft 168*b***.

The ball and socket joint 218 again provides the limited universal movement required to accommodate pivotal movement of the bolt 210 about a generally vertical axis as the side frames move relative to one another and maintain the bolster centered.

We claim:

1. A steerable truck comprising a pair of wheelsets spaced apart along a longitudinal axis of said truck and extending transverse thereto, a pair of side frames disposed on opposite sides of said longitudinal axis and extending between said wheelsets to be supported thereby, connecting means to connect each of said side frames to one of said wheelsets and accommodate relative pivotal movement beween said side frames and said one wheelset about a vertical axis, locating means acting between said side frames and the other of said wheelsets to inhibit lateral movement with respect to said truck of said side frames relative to said one wheelset, a bolster extending laterally between side frames and pivotally supported thereby for rotation about a vertical steering axis, and link means to locate laterally with respect to said truck said bolster relative to said side frame, said link means including an arm pivotally connected to said bolster for rotation about an axis coincident with said steering axis, a pair of struts pivotally connected to said arm at locations spaced apart along the longitudinal axis and on opposite sides of said steering axis for rotation about a vertical axis, each of said struts being connected to a respective one of said side frames whereby relative longitudinal or lateral movement, with respect to said truck, between said side frames is accommodated by rotation of said arm about said steering axis and loads exerted in a lateral direction with respect to said truck are substantially equally transmitted from said bolster through said arm and struts to said side frames.

2. A truck according to claim 1 wherein the axes defined by the pivotal connection between said side frames and said pivot means lie in a common plane.

3. A truck according to claim 2 wherein said plane is normal to said longitudinal axis and located midway between said wheelsets.

4. A truck according to claim 3 wherein said pivot means includes a universal joint to accommodate relative movement between said bolster and said arm about three mutually perpendicular axes.

5. A truck according to claim 4 wherein said universal joint is an elastomeric bushing.

6. A truck according to claim 1 wherein said wheelsets are rotatable about respective vertical axes from a mutually parallel position to steer said truck.

7. A truck according to claim 6 wherein said side frames are pinned to one of said wheelsets for movement therewith, relative longitudinal movement between said side frames caused by steering action of said wheelsets being accommodated by rotation of said arm about said pivot means.

8. A truck assembly according to claim 7 wherein said side frames are laterally fixed relative to the other of said wheelsets, said link means accommodating relative lateral movement between said frames by rotation of said arm about said pivot means.

9. A truck according to claim 8 wherein said side frames are laterally fixed by means of laterally extending links pivotally connected to said other wheelset and respective ones of said axes.

10. A truck according to claim 9 wherein said side frames are slidably supported on said other wheelset to accommodate steering motion of said wheelsets.

* * * * *

UNITED STATES PATENT AND TRADEMARK OFFICE

CERTIFICATE OF CORRECTION

PATENT NO. : 4,742,780

DATED : May 10, 1988

INVENTOR(S) : Ernest Waddington

It is certified that error appears in the above-identified patent and that said Letters Patent is hereby corrected as shown below:

Insert Figures 6-10 as part of Letters Patent as shown on the attached sheets.

Signed and Sealed this

Twenty-fifth Day of October, 1988

*Attest:*

DONALD J. QUIGG

*Attesting Officer*

*Commissioner of Patents and Trademarks*

UNITED STATES PATENT AND TRADEMARK OFFICE

CERTIFICATE OF CORRECTION

PATENT NO. : 4,742,780

DATED : May 10, 1988

INVENTOR(S) : Ernest WADDINGTON

It is certified that error appears in the above-identified patent and that said Letters Patent is hereby corrected as shown below:

Column 7, line 58, before "accommodate" insert --to--.

Column 8, line 26, delete "pivot means" and substitute therefor --arm--.

Column 8, line 27, before "plane" insert --common--.

Column 8, line 30, after "claim 3" delete "wherein said pivot means includes" and insert therefor --further comprising--.

Column 8, line 45, delete "about" and substitute therefor --via--, and delete "pivot means" and substitute therefor --pivotal connection--.

UNITED STATES PATENT AND TRADEMARK OFFICE

CERTIFICATE OF CORRECTION

PATENT NO. : 4,742,780

DATED : May 10, 1988

INVENTOR(S) : Ernest WADDINGTON

It is certified that error appears in the above-identified patent and that said Letters Patent is hereby corrected as shown below:

Column 8, line 49, delete "about" and substitute therefor --via--, and delete "pivot means" and substitute therefor --pivotal connection--.

Signed and Sealed this

Seventh Day of February, 1989

*Attest:*

DONALD J. QUIGG

*Attesting Officer*

*Commissioner of Patents and Trademarks*